US008595979B2

(12) United States Patent
Iimori et al.

(10) Patent No.: US 8,595,979 B2
(45) Date of Patent: Dec. 3, 2013

(54) VEHICLE REAR DOOR HAVING DIVISION BAR FOR GUIDING MOVABLE WINDOW

(75) Inventors: Yasushi Iimori, Aichi-ken (JP); Kenji Yamamoto, Kanagawa-ken (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 471 days.

(21) Appl. No.: 12/609,072

(22) Filed: Oct. 30, 2009

(65) Prior Publication Data

US 2010/0107501 A1 May 6, 2010

(30) Foreign Application Priority Data

Oct. 30, 2008 (JP) ..... 2008-279529

(51) Int. Cl.
*E05F 15/16* (2006.01)

(52) U.S. Cl.
USPC ..... 49/362; 49/349; 49/348; 49/502

(58) Field of Classification Search
USPC ..... 49/348, 349, 350, 362, 374, 502
See application file for complete search history.

(56) References Cited

U.S. PATENT DOCUMENTS

| | | | | |
|---|---|---|---|---|
| 1,937,662 | A * | 12/1933 | Nicholson | 49/136 |
| 3,656,259 | A * | 4/1972 | Stark | 49/440 |
| 4,653,230 | A * | 3/1987 | Seo et al. | 49/502 |
| 5,964,063 | A * | 10/1999 | Hisano et al. | 49/502 |
| 6,453,615 | B1 * | 9/2002 | Berta et al. | 49/349 |
| 6,523,882 | B2 * | 2/2003 | Ishikawa et al. | 296/146.8 |
| 6,560,929 | B1 * | 5/2003 | Staser et al. | 49/362 |
| 6,631,586 | B1 * | 10/2003 | Nakagomi et al. | 49/349 |
| 6,655,092 | B2 * | 12/2003 | Pacella et al. | 49/506 |
| 7,950,185 | B2 * | 5/2011 | Lefevre et al. | 49/352 |
| 2006/0156632 | A1 * | 7/2006 | Ruppert et al. | 49/502 |

FOREIGN PATENT DOCUMENTS

| | | |
|---|---|---|
| DE | 1911843 | 2/1971 |
| DE | 19703720 | 7/1998 |
| DE | 102004031631 | 1/2006 |
| JP | 60-150291 | 10/1985 |
| JP | 11-315664 | 11/1999 |
| JP | 2001-039167 | 2/2001 |
| JP | 2001-39167 | 2/2001 |

OTHER PUBLICATIONS

Germany Office action, mail date is Nov. 2010.

* cited by examiner

*Primary Examiner* — Katherine Mitchell
*Assistant Examiner* — Marcus Menezes
(74) *Attorney, Agent, or Firm* — Greenblum & Bernstein, P.L.C.

(57) ABSTRACT

A vehicle rear door includes a door panel, a door frame, a division bar, and a movable window. The movable window has a flange portion formed with teeth. The division bar includes upper and lower division bars which are separately arranged and respectively guide the flange portion so that a part of the teeth is exposed between the upper and lower division bars. Each of the upper and lower division bars has a guide wall that guides an end surface of the flange portion which is opposite to the teeth. Each of the upper and lower division bars has a mount portion. The vehicle rear door further includes a motor unit bracket fixed to the mount portions of the upper and lower division bars and supporting a pinion that is engaged with the exposed teeth between the upper and lower division bars.

11 Claims, 13 Drawing Sheets

VEHICLE REAR DOOR HAVING DIVISION BAR FOR GUIDING MOVABLE WINDOW

BACKGROUND OF THE INVENTION

The present invention relates to a vehicle rear door having a movable window that is made of a resin.

Such window, which is disclosed in Japanese Unexamined Patent Application Publication No. 2001-39167, is light in weight and easy to form in various shapes, allowing reduction of vehicle weight. In addition, such window can be used along with a lightweight and simple drive unit disclosed in, for example, Japanese Unexamined Utility Model Application Publication No. 60-150291.

The present invention is applied to a vehicle rear door having a movable window formed with teeth, a division bar guiding the teeth and a pinion engaged with the teeth, and directed to providing a vehicle rear door which allows the teeth to be positioned relative to the pinion with high accuracy and also which allows the movable window to be assembled to the division bar easily.

SUMMARY OF THE INVENTION

In accordance with an aspect of the present invention, a vehicle rear door includes a door panel including an outer panel disposed at the vehicle exterior side and an inner panel disposed at the vehicle interior side, a door frame having a vertical portion and mounted to the door panel to form a window opening, a division bar extending from the door frame into the door panel so as to divide the window opening, and a movable window made of a resin and supported between the vertical portion of the door frame and the division bar so as to move up and down. The door panel has an inside space formed of the outer panel and the inner panel. The movable window has a flange portion formed with teeth. The division bar includes upper and lower division bars which are separately arranged and respectively guide the flange portion so that a part of the teeth is exposed between the upper and lower division bars. Each of the upper and lower division bars has a guide wall that guides an end surface of the flange portion which is opposite to the teeth. The upper division bar has a mount portion provided at the lower end thereof. The lower division bar has a mount portion provided at the upper end thereof. The vehicle rear door further includes a motor unit bracket fixed to the mount portions of the upper and lower division bars and supporting a pinion that is engaged with the exposed teeth between the upper and lower division bars.

Other aspects and advantages of the invention will become apparent from the following description, taken in conjunction with the accompanying drawings, illustrating by way of example the principles of the invention.

DETAILED DESCRIPTION OF THE PREFERRED EMBODIMENTS

The following will describe the vehicle rear door according to the embodiment of the present invention with reference to the accompanying drawings.

Figure 1:
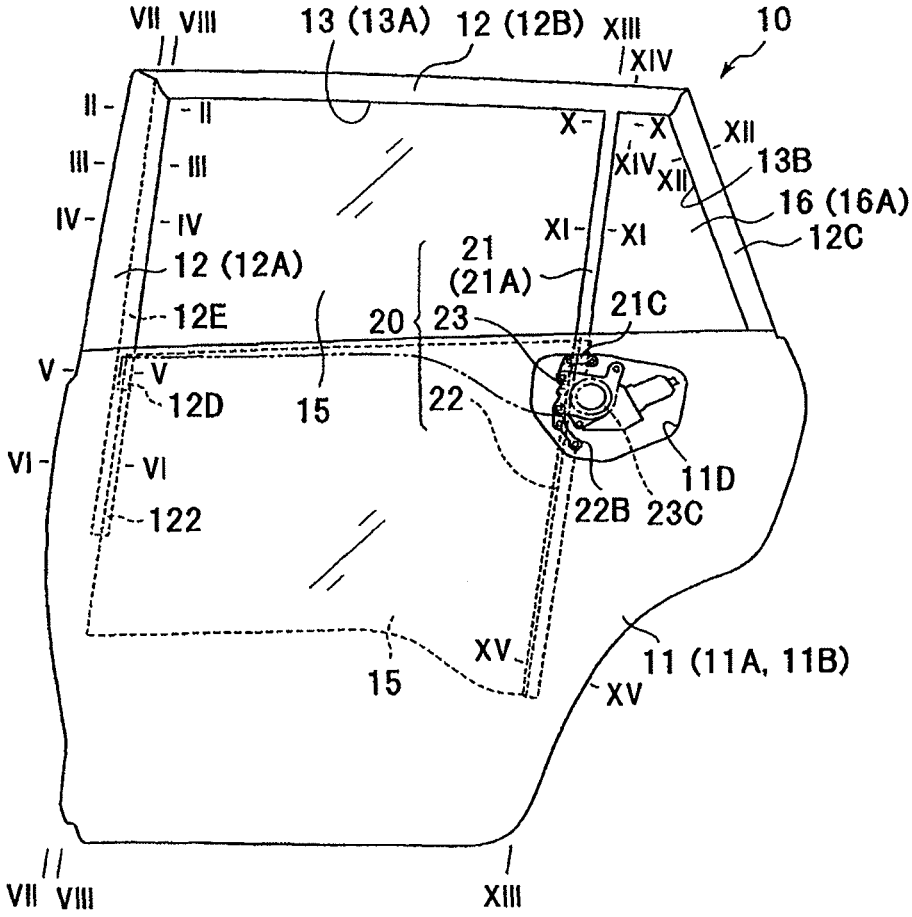
FIG. 1 shows a vehicle rear door according to an embodiment of the present invention, as viewed from the vehicle interior side.

Referring to FIG. 1, the vehicle rear door 10 is shown as viewed from the vehicle interior side. It is noted that the left-hand and the right-hand side as viewed in FIG. 1 are the front side and the rear side of the rear door 10, respectively, and that the upper and lower sides as viewed in FIG. 1 are the upper and lower sides of the rear door 10, respectively. The rear door 10 has a door panel 11, a door frame 12 and a division bar assembly 20. The door frame 12 (door sash) is provided above the door panel 11 to form a window opening 13 that is surrounded by the upper end of the door panel 11 and the door frame 12. The door panel 11 includes an outer panel 11A disposed at the vehicle exterior side and an inner panel 11B disposed at the vehicle interior side. The outer and inner panels 11A and 11B form an inside space therebetween (see FIGS. 5 through 8, 13, 15, and 17 through 21). That is, the door panel 11 has an inside space formed of the outer and inner panels 11A and 11B. The door frame 12 includes a vertical portion 12A provided on the front side of the rear door 10, a horizontal portion 12B extending horizontally from the upper end of the vertical portion 12A, and an sloping portion 12C extending obliquely downward from the rear end of the horizontal portion 12B. The door panel 11 and the door frame 12 are both made of a metal.

The division bar assembly 20 is mounted to the door panel 11 and the door frame 12 so as to divide the window opening 13 into a front opening 13A and a rear opening 13B. The division bar assembly 20 includes an upper division bar 21 extending from the horizontal portion 12B of the door frame 12 into the door panel 11, a lower division bar 22 mounted and extending in the door panel 11, and a motor unit bracket 23 mounted to the lower end of the upper division bar 21 and the upper end of the lower division bar 22 and also to the door panel 11. The upper division bar 21 has an upper end fixed to the horizontal portion 12B of the door frame 12 and a lower end fixed to the door panel 11.

The rear door 10 has a movable window 15 and a fixed window 16 which are both made of a transparent resin. The movable window 15 is supported between the vertical portion 12A of the door frame 12 and the upper and lower division bars 21 and 22 so as to move up and down. The fixed window 16 is fixedly supported in the rear opening 13B by the upper division bar 21, the horizontal and sloping portions 12B and 12C of the door frame 12, and the upper end of the door panel 11. The movable window 15 is convex toward the vehicle exterior side and has a curved cross section (see FIGS. 7, 8 and 13).

Figure 9:
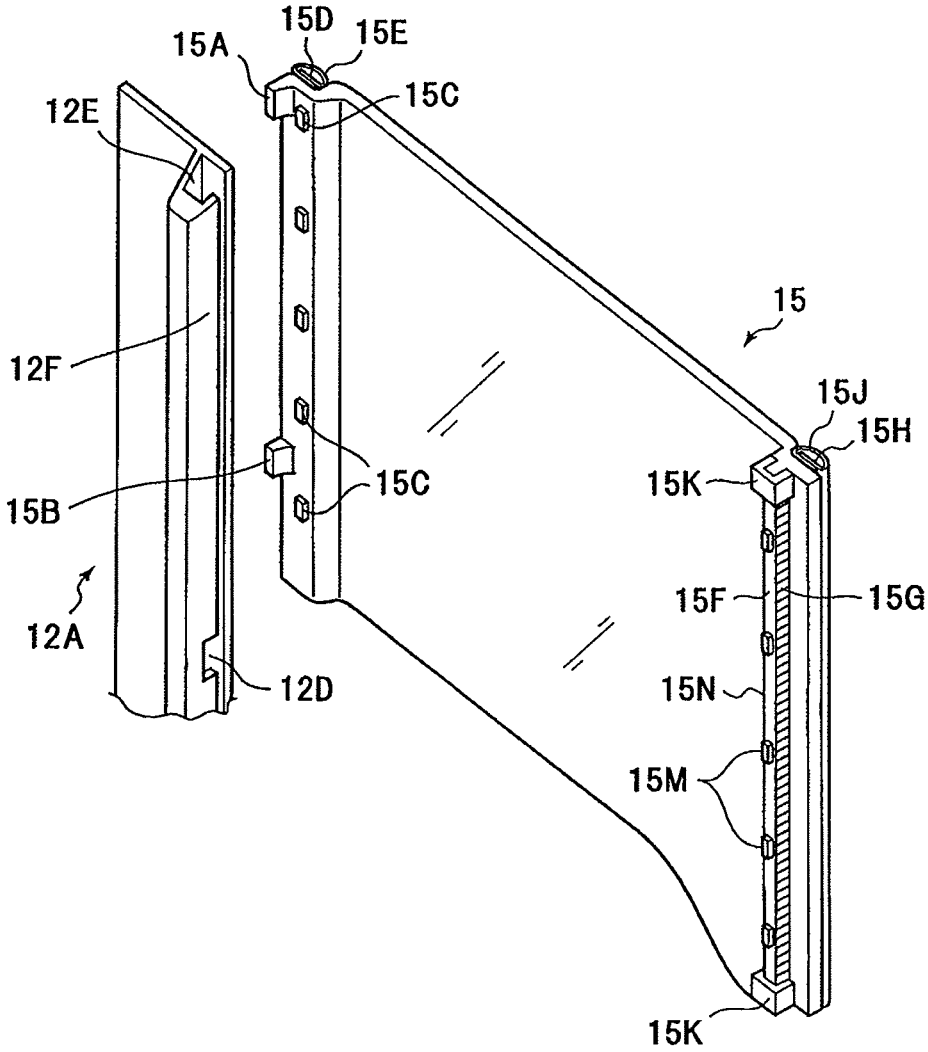
FIG. 9 is a schematic perspective view of a movable window of the rear door of FIG. 1.

FIG. 9 is a schematic perspective view of the movable window 15. The movable window 15 has a pair of hooks 15A and 15B formed at the front end thereof and projecting toward the vehicle interior side (see FIGS. 2, 4 and 7). The hooks 15A and 15B are spaced away from each other generally in vertical direction. The movable window 15 has a plurality of shoes 15C located slightly rearward of the hooks 15A and 15B (see FIGS. 3 and 8). The shoes 15C are spaced away from each other in the vertical direction, projecting toward the vehicle interior side. The hooks 15A and 15B both have an L-shaped cross section. The hook 15A is located at the upper end of the movable window 15, and the hook 15B is located below the middle of the movable window 15. The hooks 15A and 15B may be provided so as to project toward the vehicle exterior side.

Figure 2:
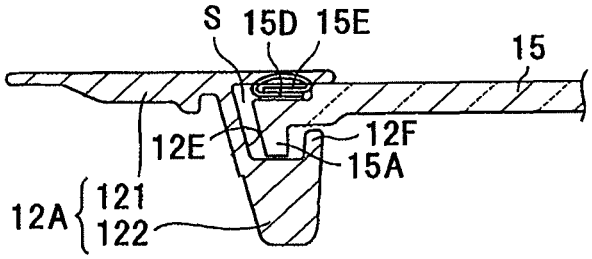
FIG. 2 is a cross-sectional view taken along the line II-II of FIG. 1.
Figure 3:
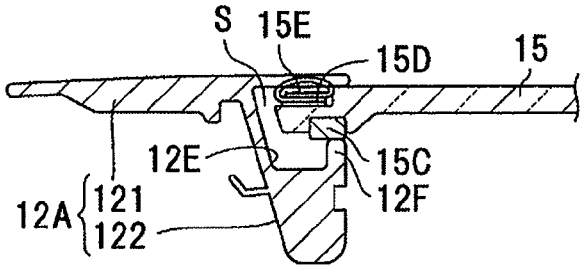
FIG. 3 is a cross-sectional view taken along the line III-III of FIG. 1.
Figure 4:
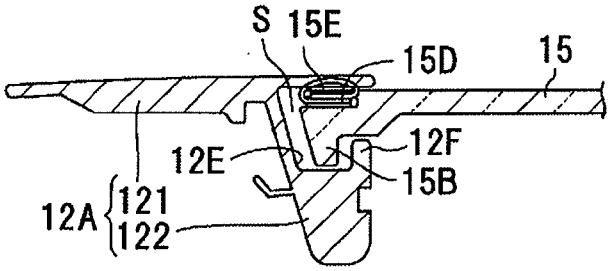
FIG. 4 is a cross-sectional view taken along the line IV-IV of FIG. 1.

The front end of the movable window 15 is formed with a vertically extending step 15D on which a low-friction weather seal 15E (weather strip) is provided for keeping rainwater or dust from entering (see FIGS. 2 through 4). In the assembled state of the rear door 10, the weather seal 15E is elastically deformed along the surface of the vertical portion 12A of the door frame 12. It is noted that the weather seal 15E illustrated in FIGS. 2 through 4 is in its undeformed state.

The vertical portion 12A of the door frame 12 has a guide groove 12E for guiding the hooks 15A and 15B and the shoes 15C formed at the front end of the movable window 15. Specifically, the vertical portion 12A includes an outer portion 121 and an inner portion 122 that extends from the outer portion 121 toward the vehicle interior side, and the guide groove 12E is formed between the outer portion 121 and the inner portion 122 (see FIGS. 2 through 6). The guide groove 12E has a projection 12F for preventing the hooks 15A and 15B from being removed from the guide groove 12E (see FIGS. 2 through 4, and 9). The guide groove 12E thus formed is generally C-shaped in cross section and slidably guides the hooks 15A and 15B of the movable window 15 while keeping the hooks 15A and 15B from being removed therefrom. The guide groove 12E surrounds the hooks 15A and 15B so as to restrict the forward, backward and lateral movement of the movable window 15.

Figure 5:
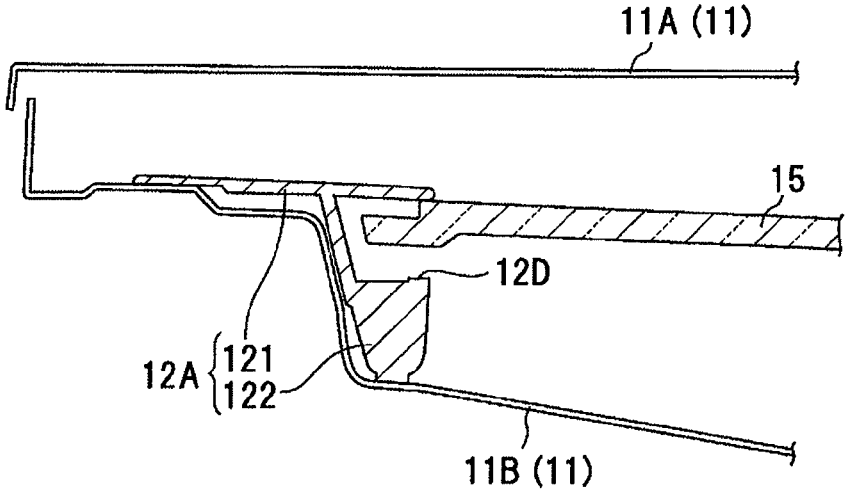
FIG. 5 is a cross-sectional view taken along the line V-V of FIG. 1.
Figure 6:
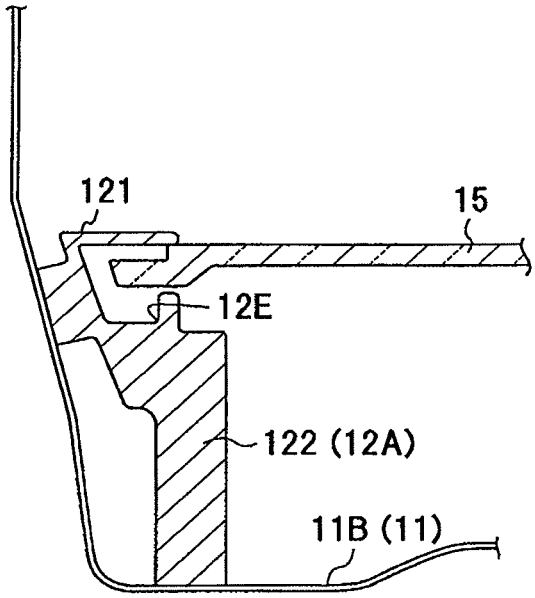
FIG. 6 is a cross-sectional view taken along the line VI-VI of FIG. 1.
Figure 7:
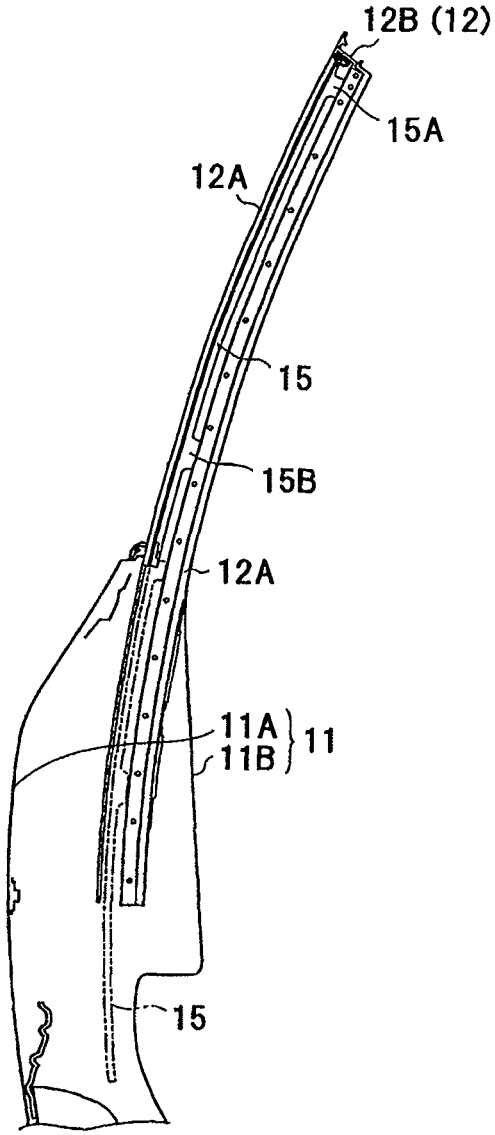
FIG. 7 is a cross-sectional view taken along the line VII-VII of FIG. 1.
Figure 8:
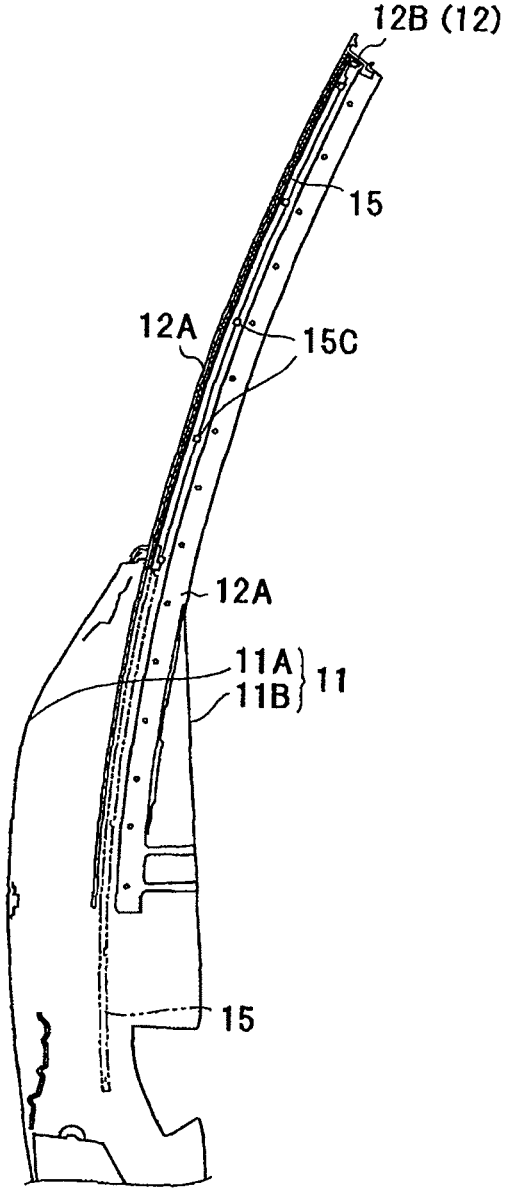
FIG. 8 is a cross-sectional view taken along the line VIII-VIII of FIG. 1.

The part of the vertical portion 12A which is located in the door panel 11 has a cut 12D through which the hooks 15A and 15B of the movable window 15 are inserted into the guide groove 12E (see FIGS. 1, 5 and 9). The cut 12D is positioned so as not to coincide with the hooks 15A and 15B wherever the movable window 15 is located between its fully open position and fully closed position. Even if either of the hooks 15A and 15B coincides with the cut 12D, the movable window 15 is not removed from the guide groove 12E when the movable window 15 is in its fully open position because the movable window 15 in such fully open position cannot be touched from the outside of the door panel 11.

When inserting the hooks 15A and 15B of the movable window 15 into the guide groove 12E of the door frame 12, firstly, the hook 15A is inserted through the cut 12D into the guide groove 12E with the movable window 15 inclined. Then the movable window 15 is moved upward relative to the vertical portion 12A, and the hook 15B is inserted through the cut 12D into the guide groove 12E. In the assembled state of the rear door 10, it is preferable that the cut 12D should not coincide with at least either of the hooks 15A and 15B within the regular moving range of the movable window 15. The movable window 15 may dispense with either one of the hooks 15A and 15B. In such a case, it is preferable that the hook should be provided at the upper end of the movable window 15 to prevent irregular movement of the movable window 15. There is a space S between the front end of the movable window 15 and the inner surface of the guide groove 12E of the vertical portion 12A (see FIGS. 2 through 4). When the hook 15B is inserted through the cut 12D into the guide groove 12E with the movable window 15 inclined, the space S serves to prevent the part of the movable window 15 located above the hook 15B from interfering with the inner surface of the guide groove 12E. The space S also serves to allow thermal expansion of the movable window 15.

With the hooks 15A and 15B of the movable window 15 located in the guide groove 12E of the vertical portion 12A of the door frame 12, the shoes 15C are in contact with the edge of the inner portion 122 of the vertical portion 12A thereby to prevent irregular movement of the movable window 15 (see FIG. 3).

Referring to FIG. 9, the movable window 15 has a flange portion 15F formed at the rear end thereof. The flange portion 15F extends in the vertical direction, projecting toward the vehicle interior side. The flange portion 15F has teeth 15G formed in the rear end surface thereof (see FIGS. 11, 16, 20 and 21). The teeth 15G is in the form of a rack, extending in the vertical direction. The rear end of the movable window 15 is formed with a step 15H on which a weather seal 15J is provided, similarly to the step 15D and the weather seal 15E provided at the front end of the movable window 15 (see FIGS. 10, 11, 17 and 20). In the assembled state of the rear door 10, the weather seal 15J is elastically deformed along the surface of the fixed window 16. It is noted that the weather seal 15J illustrated in FIGS. 10, 11, 17 and 20 is in its undeformed state. The flange portion 15F of the movable window 15 may be provided so as to project toward the vehicle exterior side, as in the case of the hooks 15A and 15B.

Figure 10:
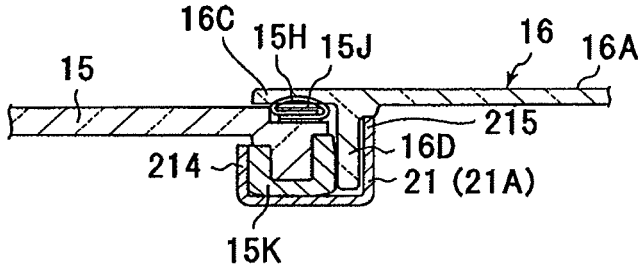
FIG. 10 is a cross-sectional view taken along the line X-X of FIG. 1.

Referring to FIGS. 9 and 10, the flange portion 15F has a pair of guide shoes 15K provided on the upper and lower ends thereof. The flange portion 15F also has a plurality of shoes 15M provided between the guide shoes 15K, which are similar to the shoes 15C.

Figure 16:
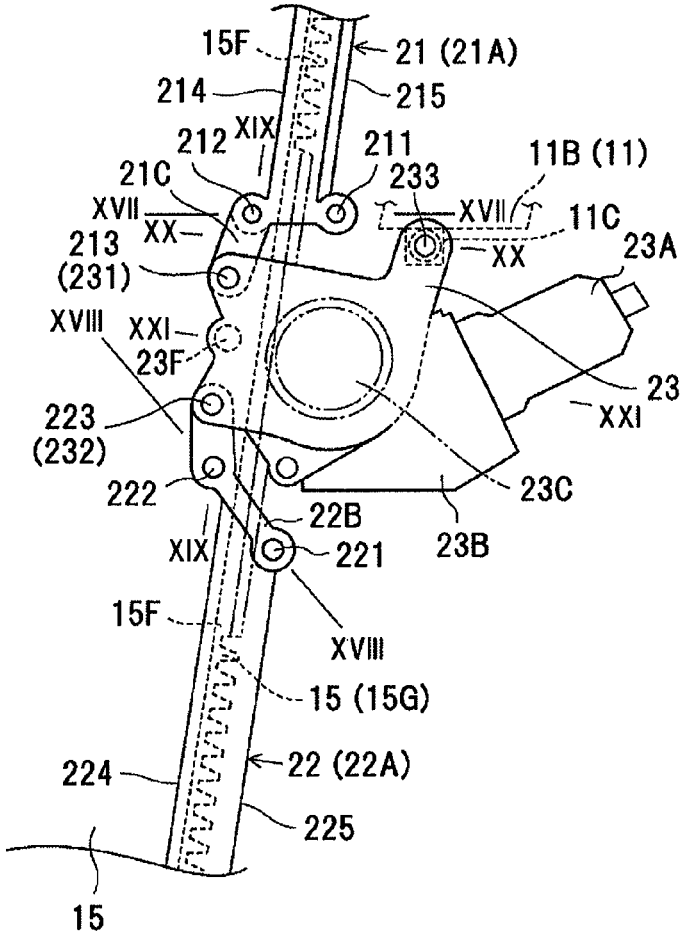
FIG. 16 is an enlarged fragmentary view of a division bar assembly of the rear door of FIG. 1.

FIG. 16 is an enlarged fragmentary view of the division bar assembly 20 of the rear door 10. The division bar assembly 20 is provided for slidably guiding the flange portion 15F of the movable window 15 and for driving the teeth 15G formed in the flange portion 15F to move the movable window 15 up and down.

The upper and lower division bars 21 and 22 of the division bar assembly 20 are both made of a metal or hard resin. Each of the upper and lower division bars 21 and 22 may be formed of a one-piece molding or a plurality of parts assembled together. The upper and lower division bars 21 and 22 are separately arranged and respectively guide the flange portion 15F of the movable window 15 so that a part of the teeth 15G is exposed between the upper and lower division bars 21 and 22. The upper division bar 21 includes a vertically extending guide portion 21A having a cross section of such a channel that is open toward the vehicle exterior side (see FIGS. 10 and 11), and mount portions 21B and 21C formed at the upper and lower ends of the guide portion 21A, respectively (see FIGS. 14, 16, 17 and 19). The mount portion 21B is fixed to the horizontal portion 12B of the door frame 12 by using a screw N inserted into the mount portion 21B through a weather-strip holder 12G that is formed in the horizontal portion 12B (see FIG. 14). The mount portion 21C is formed therethrough with threaded holes 211, 212 and 213 (see FIG. 16). The threaded holes 211 and 212 are located on the opposite sides of the guide portion 21A, and the threaded hole 213 is located below the threaded hole 212. The mount portion 21C is fixed to the inner panel 11B within the inside space of the door panel 11 by using screws N inserted through the inner panel 11B into the threaded holes 211 and 212 (see FIGS. 17 and 19).

The lower division bar 22 includes a vertically extending guide portion 22A having a cross section of such a channel that is open toward the vehicle exterior side, as with the upper division bar 21. The guide portion 22A is aligned with the guide portion 21A of the upper division bar 21. The lower division bar 22 includes mount portions 22B and 22C formed at the upper and lower ends of the guide portion 22A, respectively (see FIGS. 15 and 16). The mount portion 22B is formed therethrough with threaded holes 221, 222 and 223. The threaded holes 221 and 222 are located on the opposite sides of the guide portion 22A, and the threaded hole 223 is located above the threaded hole 222. The mount portion 22B is fixed to the inner panel 11B within the inside space of the door panel 11 by using screws N inserted through the inner panel 11B into the threaded holes 221 and 222 (see FIG. 18). The mount portion 22C is fixed to the inner panel 11B by using screw N (see FIG. 15).

The guide portion 21A of the upper division bar 21 includes a pair of parallel guide walls 214 and 215 projecting outward of the vehicle (see FIGS. 10 and 11), and the lower division bar 22 also includes a pair of parallel guide walls 224 and 225 (see FIG. 16), the structure of which is similar to that of the guide walls 214 and 215. The height of the projection of the guide wall 215 (225) adjacent to the fixed window 16 is greater than that of the guide wall 214 (224) adjacent to the movable window 15. The guide wall 214 (224) guides the guide shoes 15K provided on the flange portion 15F of the movable window 15 and the front end surface 15N of the flange portion 15F which is opposite to the teeth 15G (see FIGS. 9 through 11). The guide wall 215 (225) faces the teeth 15G of the flange portion 15F. The guide wall 214 (224) and the opposite guide wall 215 (225) serve as a part of the guide portion 21A (22A).

Figure 21:
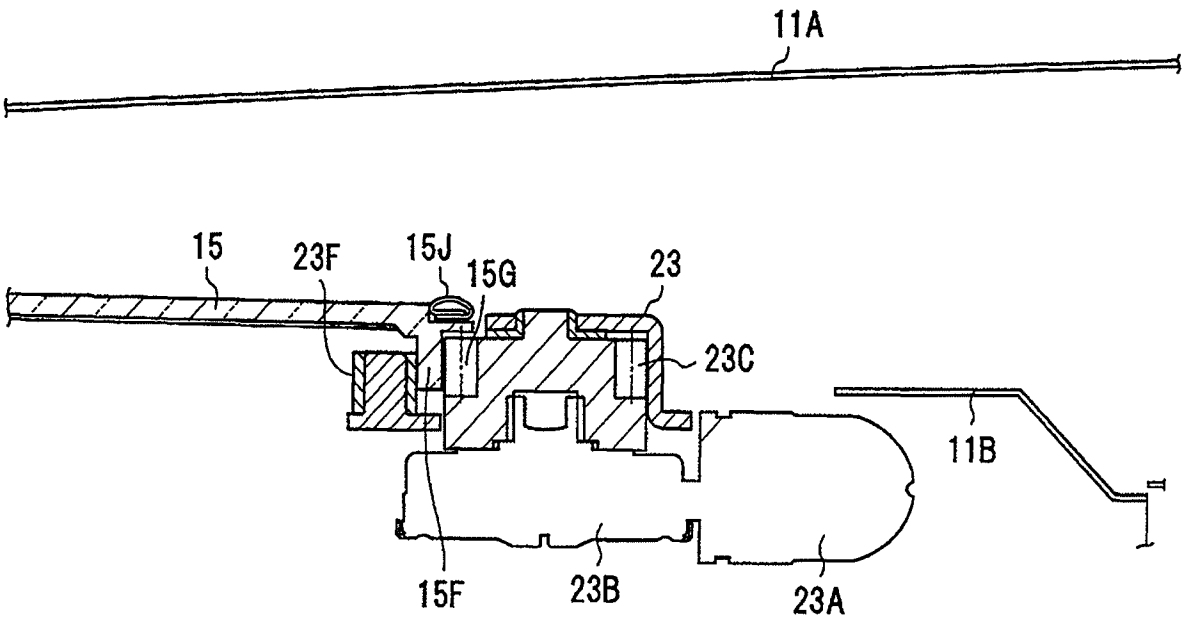
FIG. 21 is a cross-sectional view taken along the line XXI-XXI of FIG. 16.

Referring to FIGS. 16 and 21, the motor unit bracket 23 supports a motor 23A, a reduction gear 23B, and a pinion 23C that is driven by the motor 23A through the reduction gear 23B. The pinion 23C is engaged with the teeth 15G of the movable window 15 which is exposed between the upper and lower division bars 21 and 22. That is, the pinion 23C is engaged with the exposed teeth 15G between the upper and lower division bars 21 and 22. The flange portion 15F of the movable window 15 is guided between the guide wall 214 of the upper division bar 21 and the pinion 23C and between the guide wall 224 of the lower division bar 22 and the pinion 23C.

Figure 19:
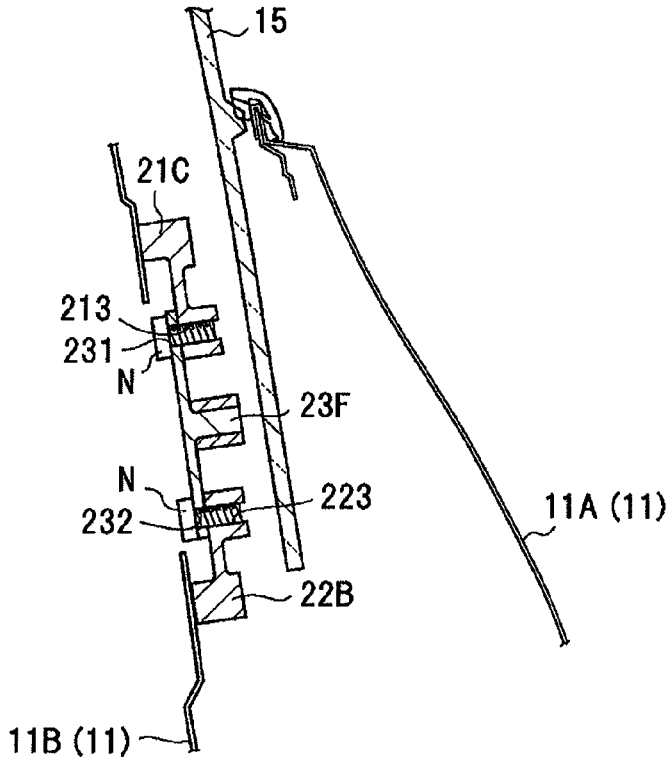
FIG. 19 is a cross-sectional view taken along the line XIX-XIX of FIG. 16.
Figure 20:
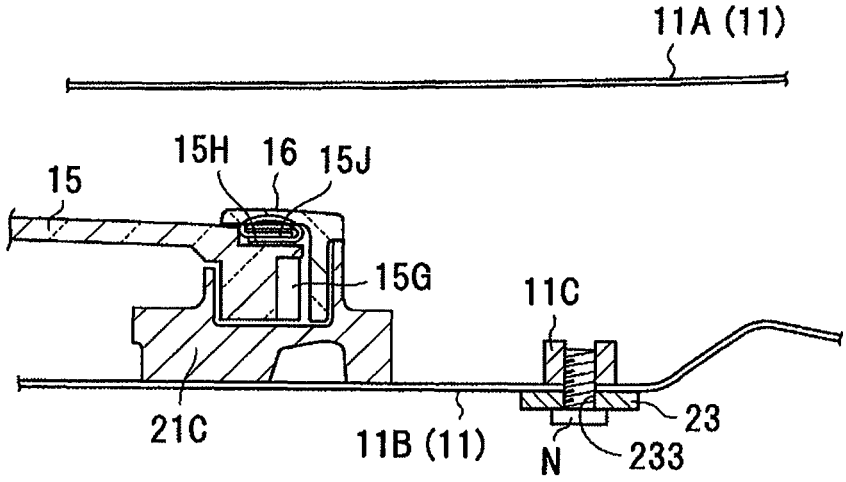
FIG. 20 is a cross-sectional view taken along the line XX-XX of FIG. 16.

The motor unit bracket 23 is formed therethrough with threaded holes 231, 232 and 233 (see FIGS. 16, 19 and 20). The threaded hole 231 is associated with the threaded hole 213 of the mount portion 21C of the upper division bar 21, and the threaded hole 232 is associated with the threaded hole 223 of the mount portion 22B of the lower division bar 22. The threaded hole 233 is associated with a weld nut 11C that is previously mounted to the inner panel 11B by welding. The screws N inserted through the threaded holes 231 and 232 are screwed into the threaded holes 213 and 223 of the mount portions 21C and 22B of the upper and lower division bars 21 and 22, respectively. The screw N inserted through the threaded hole 233 is screwed into the weld nut 11C of the inner panel 11B. The motor unit bracket 23 is fixed to the mount portions 21C and 22B of the upper and lower division bars 21 and 22 at the vehicle interior side.

The motor unit bracket 23 is formed integrally with a roller 23F (see FIGS. 16, 19 and 21). The flange portion 15F of the movable window 15 is held between the roller 23F and the pinion 23C. The roller 23F prevents deformation of the flange portion 15F (teeth 15G) and keeps the distance between the pinion 23C and the teeth 15G for firm engagement therebetween.

As described above, the motor unit bracket 23 is made previously integrally with the motor 23A, the reduction gear 23B and the pinion 23C thereby to form one unit, and the pinion 23C and the threaded holes 231, 232 and 233 of the motor unit bracket 23 have high positional accuracy, accordingly. That is, the pinion 23C is positioned with high accuracy, based on the positions of the threaded holes 231, 232 and 233, particularly the threaded holes 231 and 232.

The following will describe the procedure of mounting the division bar assembly 20 to the rear door 10. Firstly, the hooks 15A and 15B of the movable window 15 are inserted into the guide groove 12E of the vertical portion 12A of the door frame 12, and the flange portion 15F (teeth 15G) of the movable window 15 is inserted into the guide portion 21A of the upper division bar 21. Then the mount portion 21 B of the upper division bar 21 is fixed to the horizontal portion 12B of the door frame 12, and the mount portion 21C of the upper division bar 21 is fixed to the inner panel 11B within the inside space of the door panel 11. Similarly, the flange portion 15F (teeth 15G) of the movable window is inserted into the guide portion 22A of the lower division bar 22, and the mount portions 22B and 22C of the lower division bar 22 are fixed to the inner panel 11B. The upper and lower division bars 21 and 22 are separately provided, which allows the movable window 15 to be assembled to the upper and lower division bars 21 and 22 easily.

Then the motor unit bracket 23 is placed between the upper and lower division bars 21 and 22 so that the threaded holes 231 and 232 are aligned with the threaded holes 213 and 223 of the mount portions 21C and 22B of the upper and lower division bars 21 and 22, respectively. Concurrently, the roller 23F is positioned behind the flange portion 15F so that the pinion 23C is engaged with the teeth 15G of the movable window 15. With the pinion 23C engaged with the teeth 15G, the screws N positioned through the threaded holes 231 and 232 are screwed into the threaded holes 213 and 223. By so doing, the motor unit bracket 23 is fixedly mounted to the upper and lower division bars 21 and 22, without the help of the inner panel 11B.

In the present embodiment, the upper and lower division bars 21 and 22 (guide portions 21A and 22A) serve to guide the flange portion 15F (teeth 15G) of the movable window 15, allowing the movable window 15 to move up and down smoothly. With the upper and lower division bars 21 and 22 mounted to the door panel 11 and the door frame 12 properly, the motor unit bracket 23 is fixed to the upper and lower division bars 21 and 22 so that the pinion 23C is engaged with the teeth 15G of the movable window 15 and the roller 23F is located behind the flange portion 15F. By so doing, the position of the motor unit bracket 23, that is, the position of the pinion 23C relative to the teeth 15G, is determined with high accuracy. In such a case, it is necessary to push the motor unit bracket 23 toward the movable window 15 in order to engage the pinion 23C with the teeth 15G, and the motor unit bracket 23 is mounted to the upper and lower division bars 21 and 22 while being pushed toward the movable window 15. After being mounted to the upper and lower division bars 21 and 22, the motor unit bracket 23 is mounted also to the inner panel 11B by using the screw N inserted into the threaded hole 233 and the weld nut 11C. Such mounting work is performed through an access opening 11D that is formed in the inner panel 11B (see FIG. 1).

In the assembled state of the rear door 10, when the pinion 23C is driven by the motor 23A through the reduction gear 23B, power is transmitted to the movable window 15 through the teeth 15G of the flange portion 15F, and the flange portion 15F is moved in the guide portions 21A and 22A of the upper and lower division bars 21 and 22. In such a case, the shoes 15M of the flange portion 15F slide on the inner surfaces of the guide portions 21A and 22A, which prevents irregular movement of the movable window 15.

The following will describe the structure of the fixed window 16 with reference to FIGS. 1, 10 through 12, and 14. The fixed window 16 is located in the rear opening 13B that is defined by the horizontal and sloping portions 12B and 12C of the door frame 12, the upper end of the door panel 11 and the upper division bar 21.

Figure 12:
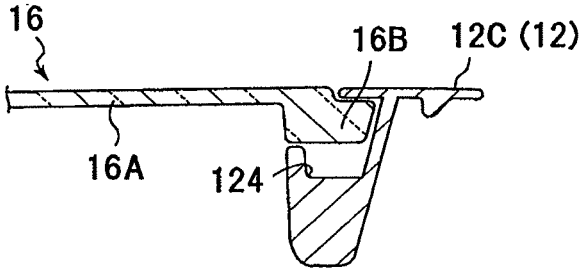
FIG. 12 is a cross-sectional view taken along the line XII-XII of FIG. 1.
Figure 13:
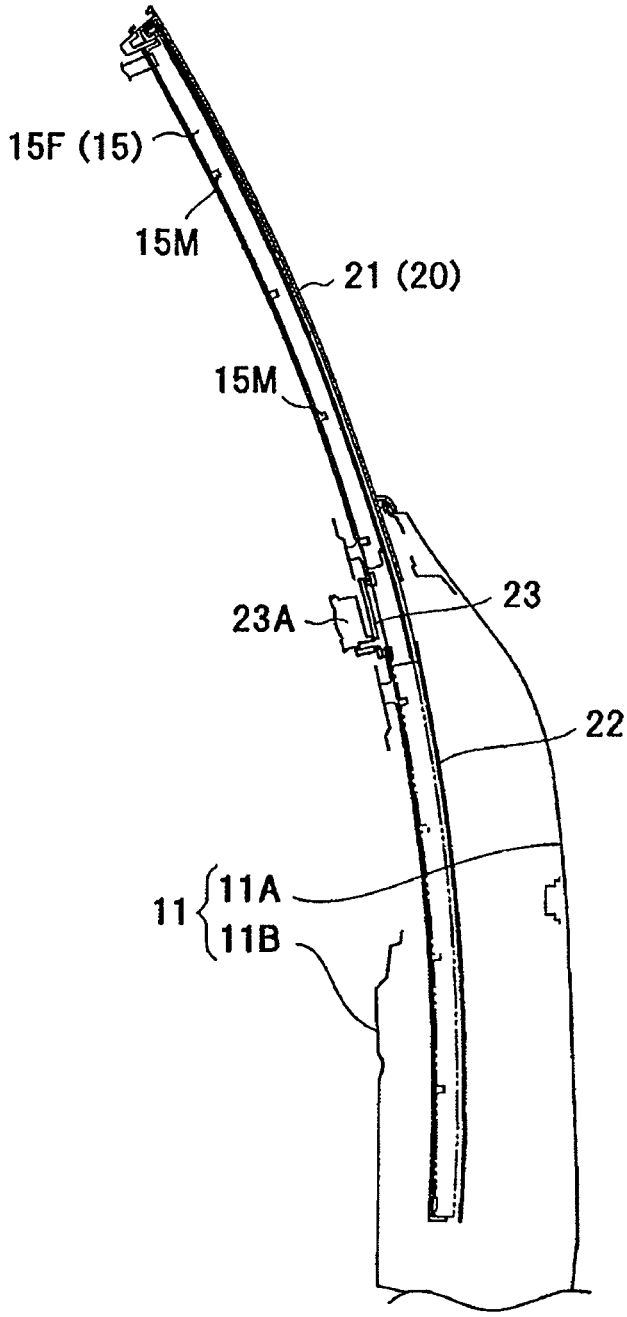
FIG. 13 is a cross-sectional view taken along the line XIII-XIII of FIG. 1.
Figure 14:
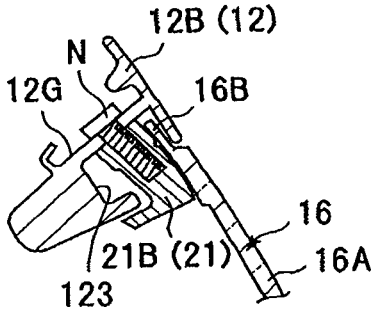
FIG. 14 is a cross-sectional view taken along the line XIV-XIV of FIG. 1.
Figure 15:
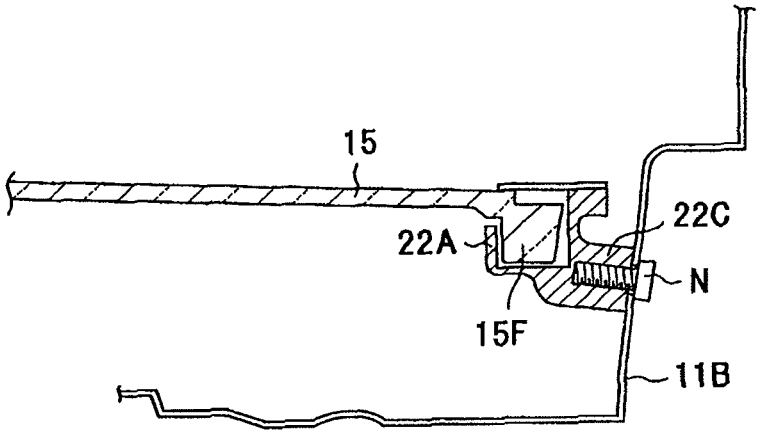
FIG. 15 is a cross-sectional view taken along the line XV-XV of FIG. 1.

As shown in FIGS. 12 and 14, the horizontal portion 12B and the sloping portion 12C of the door frame 12 are formed with grooves 123 and 124, respectively. The fixed window 16 has a generally planar main portion 16A and a thickened portion 16B that is formed in the edge of the main portion 16A so as to be inserted into the grooves 123 and 124. The thickened portion 16B is formed so as not to interfere with the mount portion 21B of the upper division bar 21 (see FIG. 14).

Figure 11:
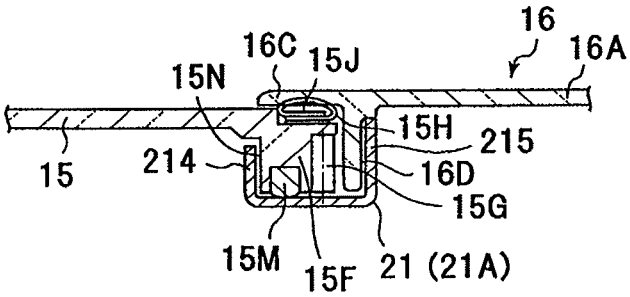
FIG. 11 is a cross-sectional view taken along the line XI-XI of FIG. 1.

The fixed window 16 has a cover portion 16C formed in the edge of the main portion 16A so as to cover the guide portion 21A of the upper division bar 21 at its opened side (see FIGS. 10 and 11). The surfaces of the cover portion 16C and the main portion 16A facing the outside of the vehicle are flush with each other. The fixed window 16 has a projection 16D formed between the main portion 16A and the cover portion 16C so as to extend in the guide portion 21A of the upper division bar 21 perpendicularly to the main portion 16A and the cover portion 16C. The projection 16D extends between the teeth 15G of the movable window 15 and the guide wall 215 of the upper division bar 21. The projection 16D extends to the lower end of the upper division bar 21, forming a part of the guide portion 21A of the upper division bar 21 (see FIG. 17). The guide portion 21A cooperates with the cover portion 16C of the fixed window 16 to form a guide with a generally C-shaped cross section for guiding therein the movement of the flange portion 15F (teeth 15G) of the movable window 15. That is, the guide portion 21A of the upper division bar 21 and the cover portion 16C of the fixed window 16 serve to guide the rear end of the movable window 15.

Figure 17:
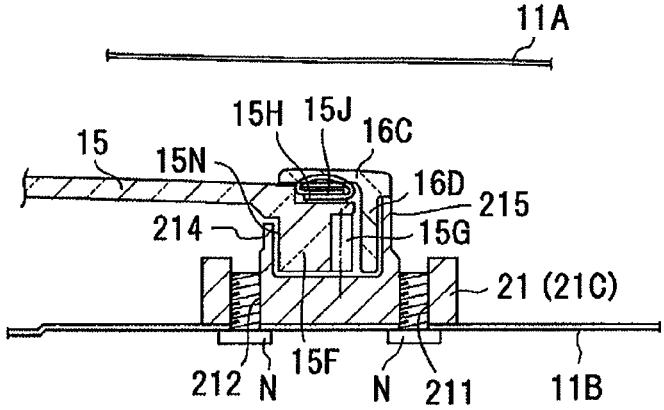
FIG. 17 is a cross-sectional view taken along the line XVII-XVII of FIG. 16.
Figure 18:
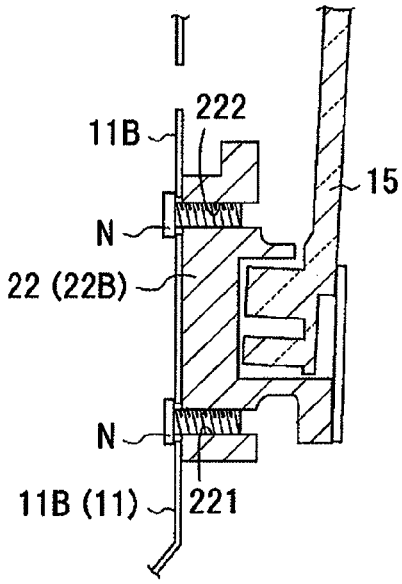
FIG. 18 is a cross-sectional view taken along the line XVIII-XVIII of FIG. 16.

As shown in FIGS. 10, 11 and 17, the projection 16D of the fixed window 16 extends in the guide portion 21A of the upper division bar 21 along the guide wall 215 to the lower end of the guide portion 21A. The projection 16D thus extending increases the torsional rigidity of the upper division bar 21 and allows the upper division bar 21 to be mounted to the fixed window 16 with high accuracy. The projection 16D is fixed to the guide wall 215 of the upper division bar 21, for example, by using an adhesive. The flange portion 15F (teeth 15G) of the movable window 15 is located in the guide portion 21A that is integrated with the projection 16D. The cover portion 16C has a length that is large enough to cover the weather seal 15J for the movable window 15. The movable window 15 extends forward through the gap between the guide wall 214 of the upper division bar 21 and the cover portion 16C of the fixed window 16. When the movable window 15 is moved up and down, the weather seal 15J slides on the inner surface of the cover portion 16C.

Since the projection 16D of the fixed window 16 is covered with the guide portion 21A of the upper division bar 21, the projection 16D does not appear when viewed from the vehicle interior side, and contact with the projection 16D is prevented, leading to a good appearance. Further, the shape of the fixed window 16 is simple and easily formed, and the cover portion 16C serves also to guide the flange portion 15F of the movable window 15, thus allowing the reduction of the number of parts of the rear door 10. Furthermore, part of the fixed window 16 serves to guide the movable window 15, which allows the size of the upper division bar 21 as measured in the transverse direction of the rear door 10 to be reduced.

Figure 22:
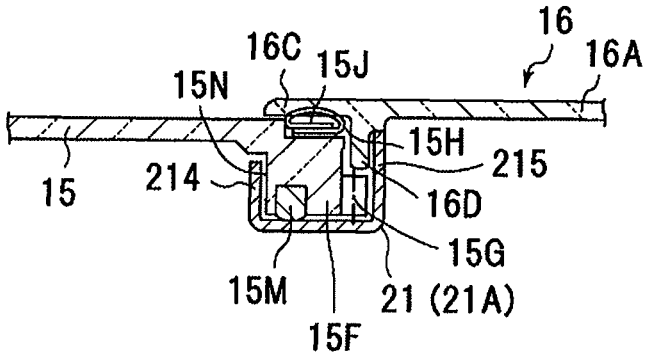
FIG. 22 is a cross-sectional view showing another embodiment of the present invention, corresponding to FIG. 11.

FIG. 22 is a cross-sectional view showing another embodiment of the present invention, corresponding to FIG. 11. In this embodiment, the projection 16D extends between the flange portion 15F of the movable window 15 and the guide wall 215 of the upper division bar 21. The length of the projection 16D of the fixed window 16 is smaller than that in the previous embodiment, so that there is a space formed between the distal end of the projection 16D and the inner surface of the guide portion 21A of the upper division bar 21. The teeth 15G extends within the space from the flange portion 15F toward the guide wall 215 of the upper division bar 21. This allows the distance between the guide walls 214 and 215 of the upper division bar 21 to be decreased and allows the size of the upper division bar 21 to be reduced.

The present invention is characterized by the structure of the division bar assembly 20 for supporting the rear end of the movable window 15. Specifically, the upper and lower division bars 21 and 22 provided separately guide the teeth 15G (flange portion 15F) formed at the rear end of the movable window 15. The upper and lower division bars 21 and 22 include the mount portions 21C and 22B to be fixed to the door panel 11, and the motor unit bracket 23 is mounted to the mount portions 21C and 22B so that the pinion 23C is engaged with the teeth 15G of the movable window 15 between the upper and lower division bars 21 and 22. Although it is preferable that the hooks 15A and 15B of the movable window 15 and the guide groove 12E and the cut 12D of the vertical portion 12A should be formed as described in the previous embodiment, the guide structure of the movable window 15 at the front and rear ends thereof is not limited to that of the present embodiment. Further, the motor unit bracket 23 may be previously or temporarily mounted to either one of the mount portions 21C or 22B of the upper and lower division bars 21 and 22 before the upper and lower division bars 21 and 22 are mounted to the door panel 11. Furthermore, the motor unit bracket 23 may be formed integrally with either one of the upper and lower division bars 21 and 22.

What is claimed is:

1. A vehicle rear door, comprising:

a door panel including an outer panel disposed at a vehicle exterior side and an inner panel disposed at a vehicle interior side, the door panel having an inside space between the outer panel and the inner panel;

a door frame having a vertical portion and mounted to the door panel as a window opening;

a division bar extending from the door frame into the door panel so as to divide the window opening; and a movable window made of a resin and supported between the vertical portion of the door frame and the division bar so as to move up and down, wherein the movable window has a flange portion with teeth, the flange portion has a first surface and a second surface, the first surface has the teeth, the second surface is opposite to the first surface, the division bar includes upper and lower division bars which are separately arranged and respectively guide the flange portion so that a part of the teeth is exposed between the upper and lower division bars, each of the upper and lower division bars has a pair of parallel guide walls, one parallel guide wall faces the first surface of the flange portion and the other parallel guide wall guides the second surface of the flange portion, respectively, wherein each of the parallel guide walls extend generally perpendicular to a major planar surface of the movable window and each of the upper and lower division bars extend in a direction from said inner panel toward said outer panel to the vehicle exterior side, the upper division bar has a mount portion provided at a lower end thereof, and the lower division bar has a mount portion provided at an upper end thereof, the vehicle rear door further comprising a motor unit bracket fixed to the mount portions of the upper and lower division bars and supporting a pinion that is engaged with the exposed teeth between the upper and lower division bars.

2. The vehicle rear door according to claim 1, wherein the motor unit bracket is fixed to the mount portions of the upper and lower division bars at the vehicle interior side.

3. The vehicle rear door according to claim 2, wherein the mount portions of the upper and lower division bars are fixed to the inner panel within the inside space of the door panel.

4. The vehicle rear door according to claim 1, wherein the motor unit bracket has a roller provided thereon, and the flange portion is held between the roller and the pinion.

5. The vehicle rear door according to claim 1, wherein each of the upper and lower division bars has a guide portion for guiding the flange portion, and the pair of parallel guide walls serves as a part of the guide portion.

6. The vehicle rear door according to claim 5, wherein the flange portion has a shoe that slides on inner surfaces of the guide portions of the upper and lower division bars.

7. The vehicle rear door according to claim 5, further comprising a fixed window fixedly supported by the upper division bar, the fixed window having a projection that extends between the flange portion and the one parallel guide wall of the upper division bar so that a space is between a side surface of the projection and an inner surface of the other parallel guide wall of the upper division bar, wherein the teeth extend within the space from the flange portion toward the one parallel guide wall of the upper division bar.

8. The vehicle rear door according to claim 1, further comprising a fixed window fixedly supported by the upper division bar, the fixed window having a projection that extends between the teeth and the one parallel guide wall of the upper division bar.

9. The vehicle rear door according to claim 1, further comprising a fixed window located next to the movable window, wherein the fixed window is fixed to the upper division bar.

10. The vehicle rear door according to claim 9, wherein the fixed window includes a projection extending toward the vehicle interior side and fixed to the one parallel guide wall of the upper division bar.

11. The vehicle rear door according to claim 10, wherein the projection extends between the first surface of the flange portion and the one parallel guide wall of the upper division bar.

* * * * *